US007434950B2

(12) United States Patent
Whitney

(10) Patent No.: US 7,434,950 B2
(45) Date of Patent: Oct. 14, 2008

(54) REFRIGERATED PRODUCT DISPLAY CASE HAVING A UNIVERSAL BALLAST MOUNTING BRACKET

(75) Inventor: Tom Whitney, Manitou, KY (US)

(73) Assignee: Gemtron Corporation, Sweetwater, TN (US)

( * ) Notice: Subject to any disclaimer, the term of this patent is extended or adjusted under 35 U.S.C. 154(b) by 281 days.

(21) Appl. No.: 11/404,010

(22) Filed: Apr. 14, 2006

(65) Prior Publication Data

US 2007/0242449 A1 Oct. 18, 2007

(51) Int. Cl.
*F21V 33/00* (2006.01)

(52) U.S. Cl. ..... 362/92; 362/432

(58) Field of Classification Search ..... 362/92, 362/432, 125, 127; 248/200, 205.1; 312/116
See application file for complete search history.

(56) References Cited

U.S. PATENT DOCUMENTS 5,607,225 A * 3/1997 Halvatzis ..... 362/125
5,645,330 A 7/1997 Artwohl et al.
5,720,540 A * 2/1998 Crown et al. ..... 362/92
5,879,070 A * 3/1999 Severloh ..... 362/125

* cited by examiner

*Primary Examiner*—Ali Alavi
(74) *Attorney, Agent, or Firm*—Diller, Ramik & Wight

(57) ABSTRACT

A universal ballast mounting bracket is of a generally T-shaped configuration defined by a leg and a pair of oppositely directed arms bent to define an angle therebetween of substantially 90 degrees. A pair of holes are provided in the leg for permanently securing each leg to a flange of a conventional ballast and each arm includes a hole in an end portion thereof for securing the bracket to a wall adjacent a ballast access opening. First and second planes to the respective leg openings and arms openings are normal to each other and relative distances and geometries therebetween are such as to effect universal mounting of the ballast mounting brackets to any one of four corners of the ballast and in any one of two positions relative to the ballast access opening.

19 Claims, 5 Drawing Sheets

REFRIGERATED PRODUCT DISPLAY CASE HAVING A UNIVERSAL BALLAST MOUNTING BRACKET

BACKGROUND OF THE INVENTION

This invention is directed to refrigerated product display cabinets or cases which are used in self-service markets, stores and other establishments in which products are illuminated, viewed, selected and purchased.

The invention is particularly directed to a refrigerated display case or cabinet which is operated below external ambient temperature. Typically, such display cases include one or more insulated glass doors through which products, such as ice cream, yogurt, or the like, on shelves in an interior refrigerated compartment can be viewed, selected and removed. The display doors can be mounted for sliding movement or pivotal movement and each door typically closes a large opening defined by a door frame. More often than not, a typical door frame includes upper and lower horizontal frame members, opposite vertical end members, and therebetween one or more vertical mullions. Illumination is generally provided by florescent tubes conventionally mounted vertically along the vertical mullions and/or end frame members or horizontally along the horizontal top frame member. Conventional electrical ballasts are associated with the florescent tubes, and heretofore such ballasts have been mounted in a number of different ways with respect to the upper horizontal frame member and vertical mullions of a typical conventional refrigerated display case.

As one typical example of ballast mounting, a ballast which includes oppositely directed mounting flanges and mounting holes or slots is fastened against an inside or a cold side wall of a vertical mullion or an upper horizontal frame member, and a separate cover then covers the ballast and is separately secured to the vertical mullion or upper horizontal frame member. When a ballast is so attached to an upper horizontal frame member, servicing from the exterior of the refrigerated display case is oft times difficult and time-consuming because a service person must open the display door associated with a door opening, reach in and above, and manipulate fasteners to remove the cover and ballast, disconnect the ballast from wiring, reconnect the new ballast and reinstall and recover the same. A solution to the latter problem is proposed in U.S. Pat. No. 5,720,540 granted on Feb. 24, 1998 to Charles E. Crown et al. which initially describes the conventional use of a ballast can into which a ballast is housed and which can be accessed through an opening of the ballast can typically closed by a door. As the patentees explain, when prior art ballast cans are mounted on the inside rearward facing wall of a frame, the access to the ballast can opening is in a direction from the rear of the display case resulting in the same problem as that presented when the ballast is directly attached to a horizontal upper frame member or a vertical mullion. The latter patent provides a ballast door which opens downwardly, as one example, and the ballast can be carried by the ballast door to effect better access for repair/replacement purposes.

Typically, ballasts can also be housed in vertical mullions, as disclosed in U.S. Pat. No. 5,645,330 granted on Jul. 8, 1997 in the name of Paul J. Artwohl et al. This patent acknowledges the utilization of vertical mullions to mount and house florescent tube ballast but conventional mounting systems therefor are said to make it difficult and time-consuming to gain access to the ballast for service and replacement. The patentees propose forming a side access opening in a side wall of a vertical mullion and removably connecting a conventional ballast to a ballast drawer which can be slid into and out of the vertical mullion through the side access opening. The ballast drawer includes a support plate having a pair of lanced tabs which rententatively engage complementary tongues on the ballast. A pair of fasteners secure the ballast drawer to the vertical mullion which is then covered by a cover plate. Though providing a solution to an acknowledged problem, the ballast drawer concept presents additional problems, most notable among which are the cost to manufacture the ballast drawer, including blanking and forming operations, particularly with respect to forming the lanced tabs and assembling the ballast relative thereto. In addition, the ballast drawer can only be inserted into the side wall access opening of the vertical mullion in one relative position between the two which can increase, not decrease, disassembly, servicing/replacement and reassembly.

BRIEF SUMMARY OF THE INVENTION

In keeping with the invention, a refrigerated display case includes a product compartment which is conventionally illuminated by one or more florescent tubes utilizing a ballast. The ballast is accessed through an opening in a support and is connected to the support by a pair of "universal" ballast mounting brackets. The mounting brackets are connected to opposite ends of the ballast and are of a "universal" construction, such that any mounting bracket can be connected to either end of a conventional ballast adjacent any of four corners of the ballast and can be fastened in either of two positions with respect to the ballast access opening and the support associated therewith. The ballast mounting brackets are permanently connected to oppositely directed flanges of the ballast and only two fasteners are utilized to secure the ballast to the support adjacent the access opening. Should the ballast fail, the two fasteners/screws need but be removed, the ballast and mounting plates discarded and a new ballast with universal mounting brackets secured thereto can be readily reassembled, rewired and secured to the support.

The access opening for the ballast is preferably formed in a side wall of a vertical mullion or a vertical end member of the display case door, but it can equally be formed in a wall of the upper horizontal frame member.

Each of the ballast mounting brackets is of a generally T-shaped configuration defined by a leg and oppositely directed arms. At least one mounting hole is provided in the leg and another mounting hole is provided in each of the arms. A leg of each of two T-shaped mounting brackets is permanently directed to one of oppositely directed flanges of the ballast and one of the holes in each arm receives a fastener for connecting each T-shaped mounting bracket to a vertical mullion or other support structure associated with a refrigerated display case. The "universal" construction of each T-shaped mounting bracket is achieved by spacing the hole in each arm an identical distance to a plane normal to the arms and passing through the opening of the leg. In this fashion no matter the orientation and securement of the leg with respect to either flange, adjacent either side or at any corner of the ballast, the mounting opening of the arm is precisely located such that the distance between the most remote mounting openings of the arms corresponds to the distance between openings in the vertical mullion which receive fasteners for retaining the ballast in internal relationship within a vertical mullion.

The leg of each universal ballast mounting bracket is also bent substantially 90 degrees relative to the arms which permits the ballast and legs to be inserted through and withdrawn from the access opening of the vertical mullion, while at the same time, opposite arms can be fastened to an exterior surface of a side wall of the vertical mullion. The latter effects universal securement of the ballast mounting brackets to the ballast or other electrical components and an associated housing to thereby render servicing, replacement and/or repair of a ballast far simpler and less costly than heretofore provided.

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENT

Figure 1:
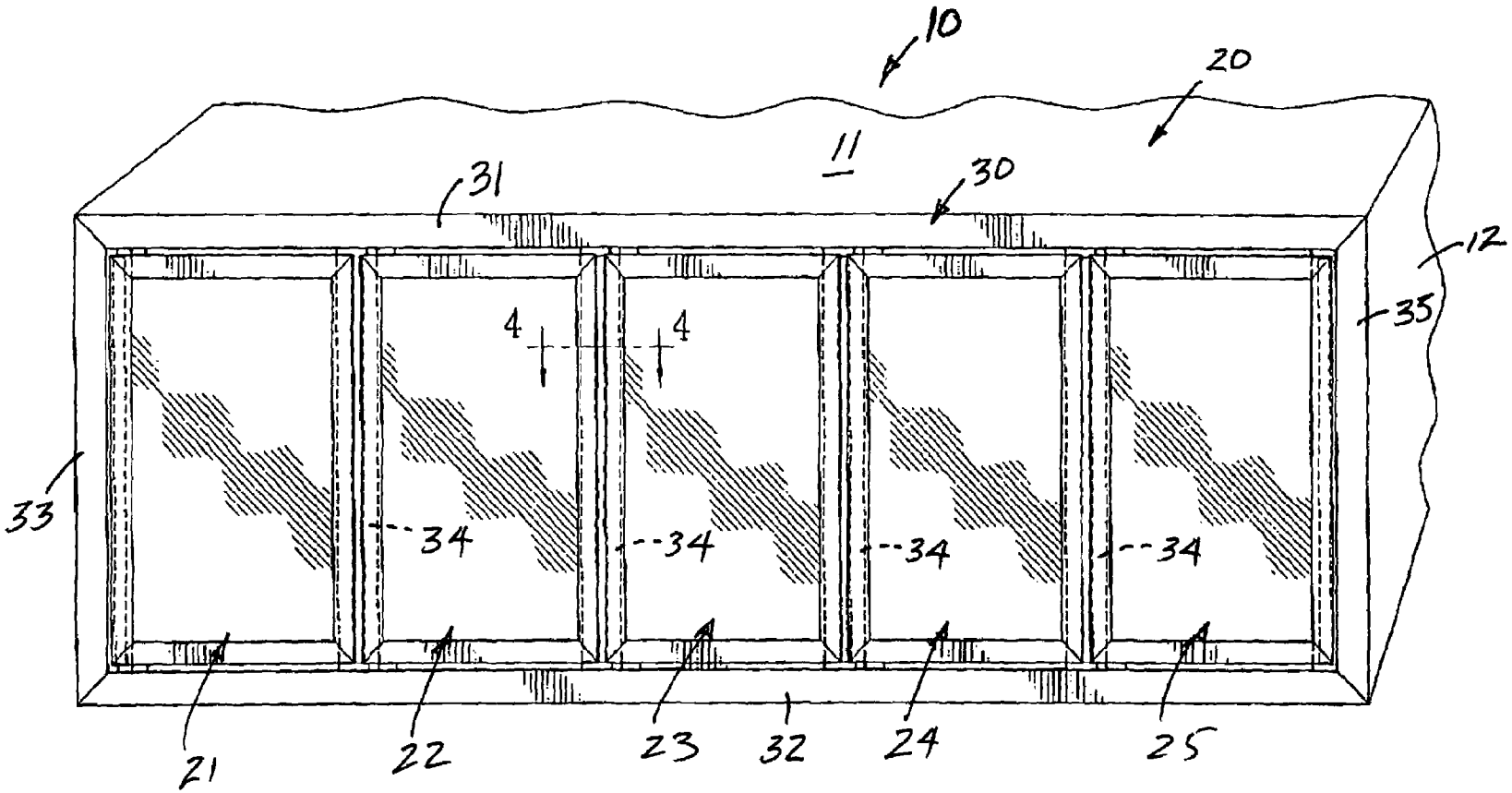
FIG. 1 is a fragmentary front perspective view, and illustrates a refrigerator display cabinet including a frame defined by upper and lower substantially horizontal frame members, opposite vertical end frame members and a plurality of vertical mullions therebetween defining five door openings and an IG display door associated with each opening.

An illuminated refrigerated display cabinet, case, walk-in or the like is illustrated in FIG. 1 of the drawings, and is generally designated by the reference numeral 10.

Figure 2:
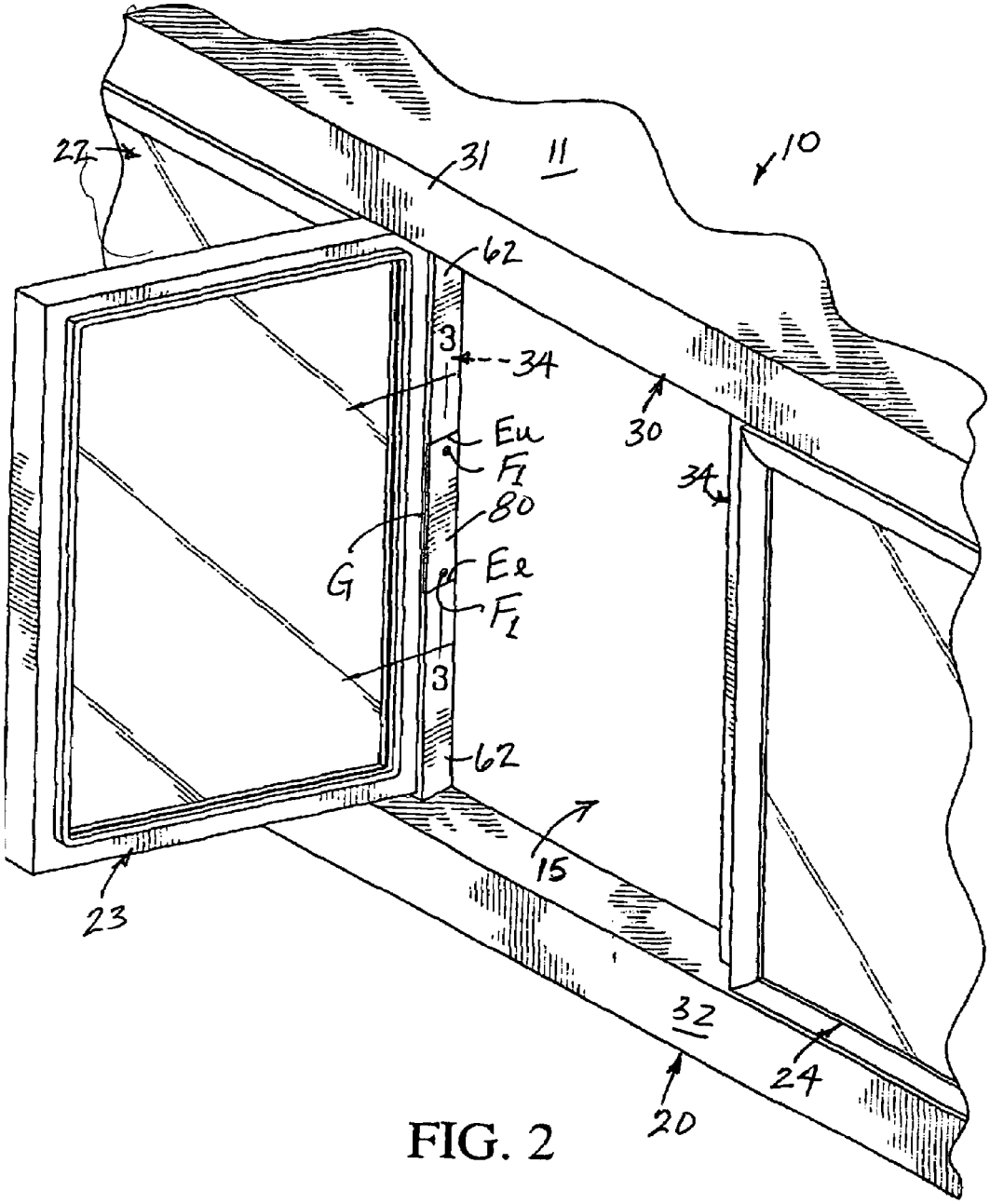
FIG. 2 is a fragmentary perspective front view of the refrigerated display case of FIG. 1, and illustrates one of the display doors in its open position and an aesthetic cover covering a ballast access opening through which a ballast is introduced into and removed from an interior volume of the vertical mullion and secured thereto by opposite universal ballast mounting brackets.

The display cabinet 10 may be, for example, a self-contained refrigerated unit which, after manufacture, is shipped to a self-service market, store or like establishment in which perishable food items are stored on shelves (not shown) or the display cabinet 10 can be a so-called built-in by which the cabinet 10 can be framed-out at the new site. In either case, the display cabinet 10 includes a top wall 11, one of two opposite side walls 12, a bottom wall and rear wall (both not shown) which collectively define an interior refrigerated product compartment 15 (FIG. 2) which is kept substantially below outside ambient temperature by a conventional cooling system (not shown).

A front of the display cabinet 10 includes a metal door frame and door assembly 20. The door frame and door assembly 20 includes a metal door frame 30 and a plurality of conventional IG display doors 21 through 25 (FIG. 1), each of which includes upper and lower vertical pivots (not shown) for pivoting each door 21 through 25 to respective upper and lower substantially parallel horizontal frame members 31, 32 of the door frame 30 which also includes opposite substantially parallel vertical end frame members 33 and therebetween four substantially identical parallel vertical extruded metal mullions or frame members 34. Each display door 21-25 can be pivoted from the closed positions (FIG. 1) to the open position (FIG. 2) to access the product compartment 15 in a conventional manner.

Each of the vertical mullions 34 (FIG. 4) is of a generally H-shaped transverse cross-sectional configuration, and each vertical mullion 34 includes opposite substantially vertical parallel side walls 41, 42 spanned by a web 43 and defining with a metal contact plate 45 an internal volume or storage area 50. A florescent tube Ft is conventionally supported within the product compartment 15 along the web 43 which carries appropriate electrical sockets/contacts and wiring which is also appropriately connected to a conventional ballast B located in the ballast volume 50. A transparent cover Tc covers the florescent tube or lamp Ft in a conventional manner and aesthetic plastic covers 61, 62 are conventionally snap-secured to the vertical mullion 34 and substantially cover the respective walls 41, 42, except for a gap G (FIG. 2) between upper and lower edges Eu, Ee, respectively, of the cover or covering 62 through which is exposed the side wall 42 and means 52 (FIGS. 3 and 5) in the form of an elongated generally polygonal slot which accesses the ballast volume or like electrical component volume 50. The width and length of the access opening 52 is such as to readily pass therethrough the ballast B (FIG. 5) to which is attached at opposite ends thereof through ballast flanges F (FIG. 6) and associated ballast flange openings Ob a universal ballast mounting bracket 70.

Figure 6:
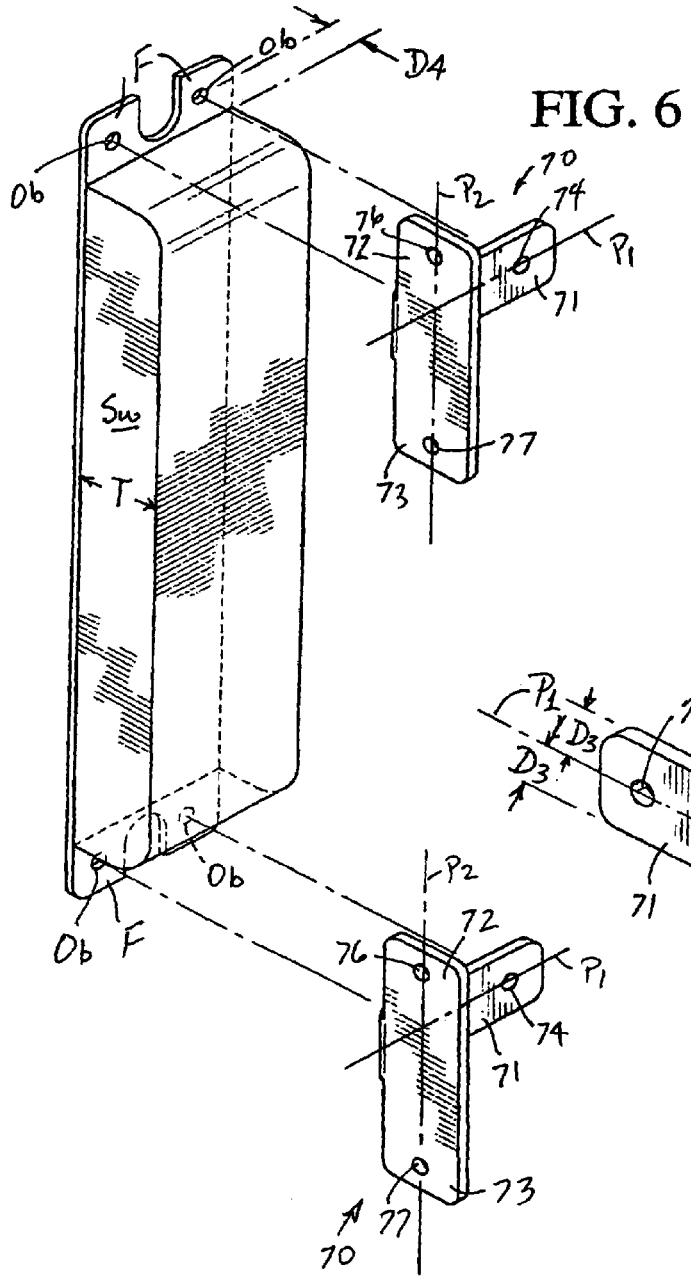
FIG. 6 is an exploded perspective view, and illustrates the two universal ballast mounting brackets prior to being assembled to flanges of a ballast.
Figure 7:
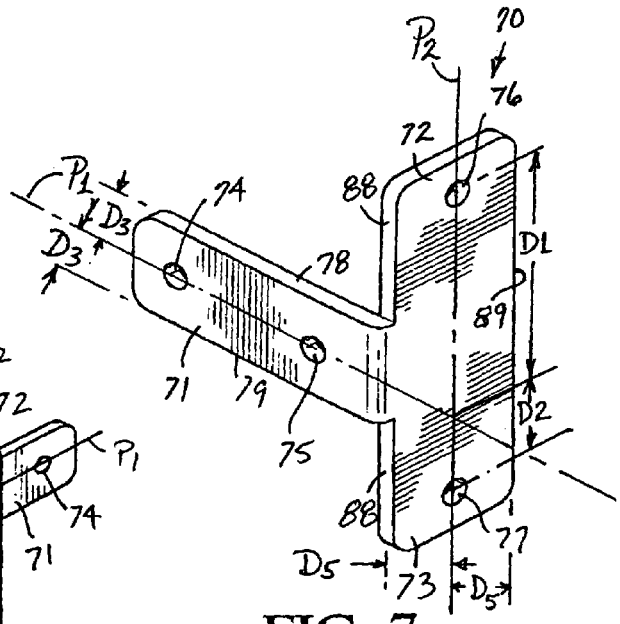
FIG. 7 is a perspective view of the universal ballast mounting bracket of the present invention, and illustrates the generally T-shaped configuration thereof defined by a leg bent substantially normal to a pair of oppositely directed arms, each having at least one opening for respectively permanently securing the leg to a flange of the ballast and securing the mounting bracket to an exterior surface of the vertical mullion side wall.

As is best illustrated in FIGS. 6 and 7 of the drawings, the universal ballast mounting bracket 70 is of a substantially T-shaped configuration defined by a leg or leg portion 71 which is substantially normal to oppositely directed arm portions or arms 72, 73. The leg 71 of each universal ballast mounting bracket 70 is disposed or bent to define an angle of substantially 90 degrees with respect to the arms 72, 73 (FIG. 7).

Figure 5:
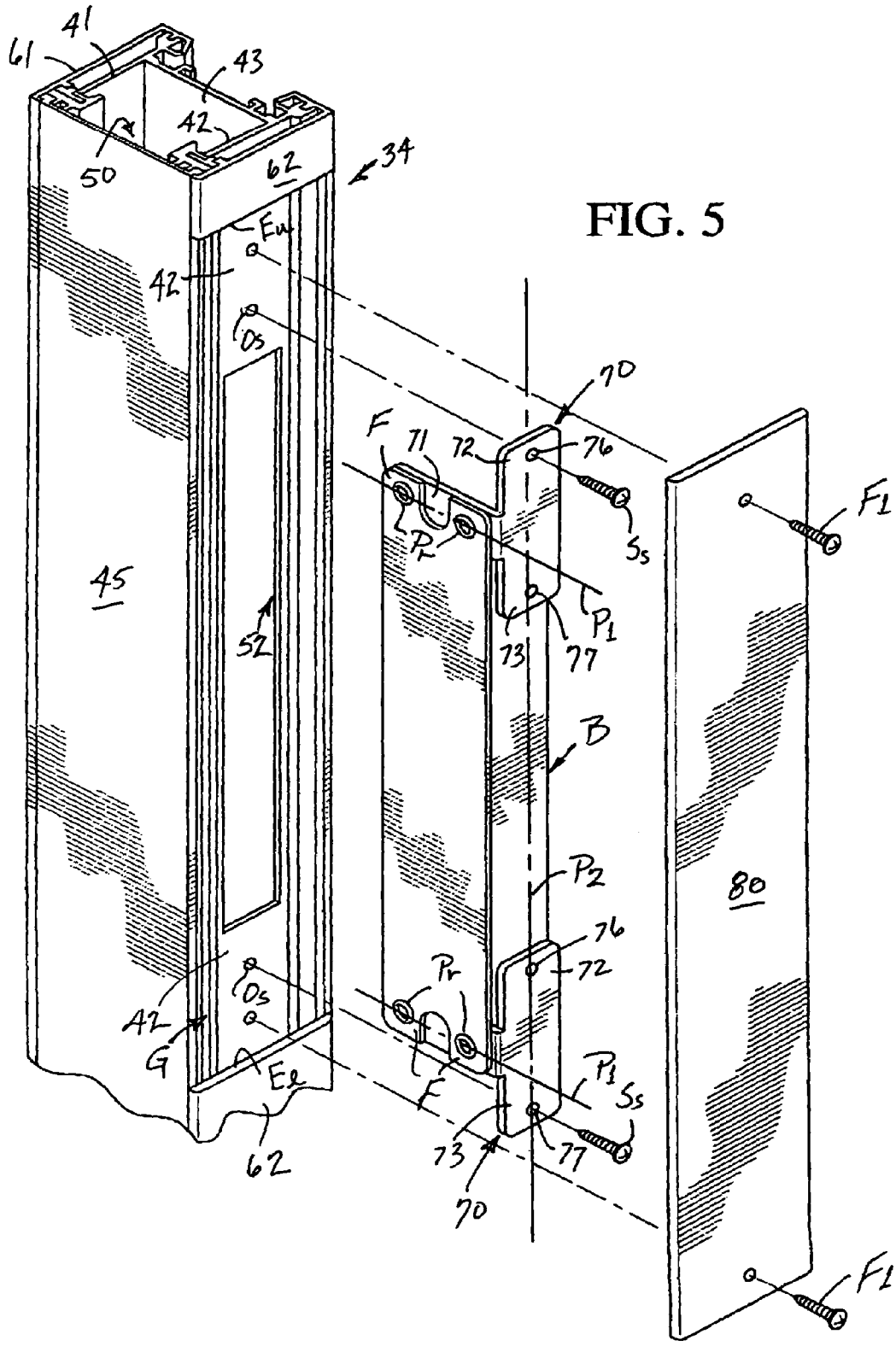
FIG. 5 is a fragmentary exploded perspective view, and illustrates an access opening in a side wall of the vertical mullion, a ballast having opposite universal ballast mounting brackets permanently secured thereto, and a cover plate.

First means 74, 75 in the form of openings in the leg portion 71 are provided for securing each universal ballast mounting bracket 70 to one of the flanges F of the ballast B through the openings Ob thereof unitizing pop rivets Pr (FIG. 5). Second means 76, 77, each also in the form of an opening, are provided for securing each universal mounting bracket 70 with respect to the side wall 42 of the mullion 34, as is apparent in FIG. 5 and shall be described more fully hereinafter.

Figure 3:
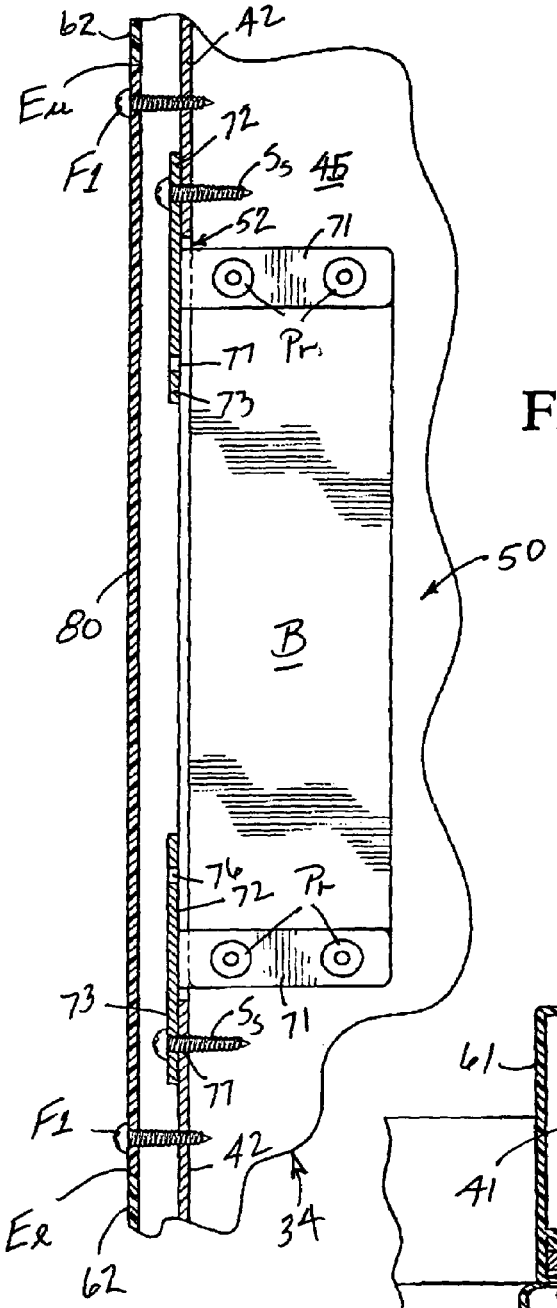
FIG. 3 is an enlarged vertical cross-sectional view taken generally along 3-3 of FIG. 2, and illustrates the two universal mounting brackets mounting the ballast within the volume of the vertical mullion.
Figure 4:
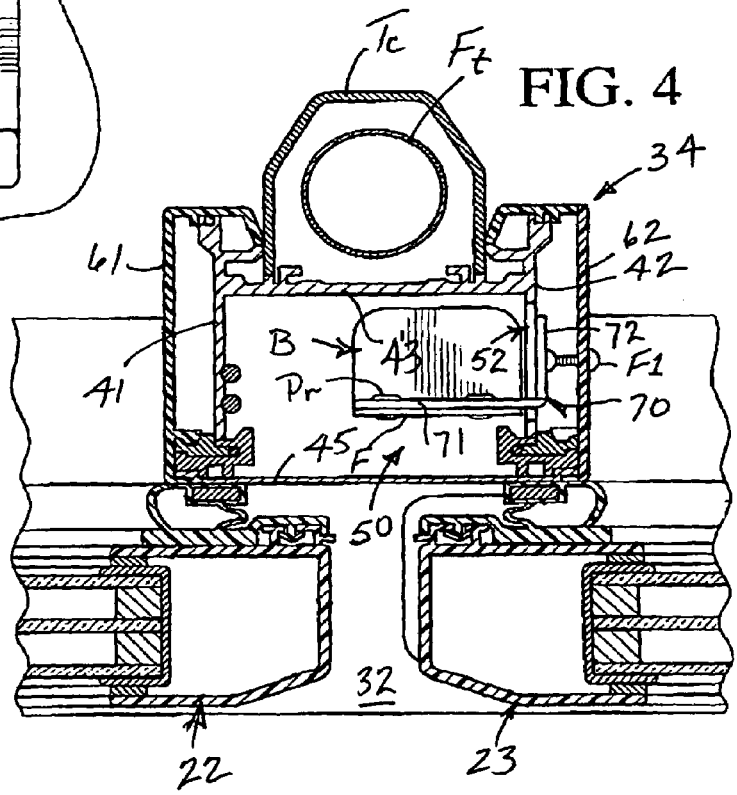
FIG. 4 is an enlarged fragmentary cross-sectional view taken generally along line 4-4 of FIG. 1, and illustrates the ballast mounted within the volume of the vertical mullion.

A first plane P1 (FIG. 7) passes through the axes of the openings 74, 75 and in the assembled relationship illustrated in FIG. 5, the planes P1, P1 of the pair of universal ballast mounting brackets 70, 70 secured to the ballast B are in substantially parallel relationship to each other. A second plane P2 passing through the axes of the openings 76, 77 of the respective arms 72, 73 is substantially normal to the first plane P1 of each ballast mounting bracket 70 (FIG. 7) and is also substantially normal to both planes P1, P1 in the assembly of the ballast and universal ballast mounting brackets 70, 70 of FIG. 5. As is best illustrated in FIG. 7, distances D1, D2 are identical to each other and respectively define the normal distance from the axes of the respective openings 76, 77 to the point of intersection between the planes P1, P2. Accordingly, irrespective of whatever universal ballast mounting bracket 70 is permanently secured by the pop rivets Pr to the flanges F, F of the ballast B, one opening 76 or the other opening 77, as is reflected by the upper and lower universal ballast mounting brackets 70, 70 of FIG. 5, can receive therein sheet metal screws Ss which are fastened into openings Os (FIG. 5) of the side wall 42 of the vertical mullion 34 (FIG. 3). The ballast B with the universal ballast mounting brackets 70, 70 permanently secured thereto is introduced through the slot 52 into the volume or storage area 50. The distance between the openings Os, Os (FIG. 5) is equal to the distance between the openings 76, 77 of the respective upper and lower universal ballast mounting brackets 70, 70 of FIG. 5, and the latter relationship would remain the same if, for example, the upper and lower universal ballast mounting brackets 70, 70 of FIG. 5 were interchanged. The latter relationship permits the manufacture of but a single universal ballast mounting bracket 70 and the utilization thereof at either end of the ballast B to effectively secure the same within the ballast storage area 50 once the sheet metal screws Ss have been driven home (FIG. 3). Thereafter, a cover plate 80 (FIGS. 2, 3 and 5) covers the gap G and is fastened by conventional screws/fasteners F1 to the side wall 42 of the vertical mullion 34 in the manner clearly apparent from FIGS. 3 and 5.

The universal nature of the ballast mounting bracket 70 is further enhanced by two additional dimensional and geometric relationships. These include the fact that the normal distance D3 between each edge 78, 79 of the leg 71 to the plane P1 is substantially identical to the normal distance D4 (FIG. 6) measured between an end wall Ew of the ballast and the openings Ob of the flange F. The latter dimension/geometry allows the universal ballast mounting bracket 70 to be secured to the flanges F on the opposite side of the ballast B, as compared to FIG. 5, or alternatively the universal ballast mounting brackets 70, 70 can be attached catercorner, as, for example, with the lower universal ballast mounting bracket 70 of FIG. 5 being connected such that the arms 72, 73 are adjacent the lower left-hand corner of the ballast B or vice-versa, namely, the upper universal ballast mounting bracket 70 of FIG. 5 being connected to the upper flange with F of the ballast B such that the arms 72, 73 are adjacent the upper left-hand corner of the ballast B. Thus, four alternatively relative locations of the universal ballast mounting brackets 70 with respect to the ballast B are possible and in each the openings 76 and/or 77 will be in alignment with the openings Os because the distance D5 (FIG. 7) between the second plane P2 and edges 88, 89 of the arms 72, 73 are identical and are substantially one-half the thickness T (FIG. 6) of the ballast B. Therefore, no matter at which corner of the ballast B the universal ballast mounting brackets 70 (FIG. 5) are mounted to the flanges F of the ballast B, the second plane P2 bisects the thickness T of the side walls Sw of the ballast B and, when assembled as earlier described, the plane P2 will at all times pass through the axes of the openings Os with associated ones of the holes 76 and/or 77 aligned therewith. The latter universal nature of the ballast mounting bracket 70 effects extremely rapid assembly/disassembly, discard and/or re-assembly through the utilization of but two sheet metal screws Ss and a like number of sheet metal screws or fasteners F1 for the cover plate 80.

Although a preferred embodiment of the invention has been specifically illustrated and described herein, it is to be understood that minor variations may be made in the apparatus without departing from the spirit and scope of the invention, as defined by the appended claims.

What is claimed is:

1. A display case comprising a housing defining a product compartment, means for defining an electrical component volume, means for accessing the electrical component volume, an electrical component housed substantially within the electrical component volume, a pair of mounting brackets, first means for securing each mounting bracket to the electrical component, second means for securing each mounting bracket with respect to said housing substantially adjacent said accessing means, a first plane passing through each first securing means with said first planes being in substantially parallel relationship to each other, a second plane substantially normal to said first planes passing through said second securing means, and the distance between each second securing means of each mounting bracket and the most adjacent first plane being substantially identical to thereby effect universal securement of the mounting brackets to the electrical component and the housing.

2. The display case as defined in claim 1 wherein each mounting bracket is defined by mirror-image portions on opposite sides of the first plane.

3. The display case as defined in claim 1 wherein each mounting bracket includes first and second portions disposed substantially 90 degrees to each other.

4. The display case as defined in claim 1 wherein each mounting bracket includes first and second portions bent substantially 90 degrees to each other.

5. The display case as defined in claim 1 wherein each mounting bracket is of a substantially T-shaped configuration.

6. The display case as defined in claim 1 wherein each mounting bracket is of a substantially T-shaped configuration defined by a leg and oppositely directed arms, and said leg and arms include said respective first and second securing means.

7. The display cabinet as defined in claim 1 wherein said first and second securing means each include at least one opening.

8. The display cabinet as defined in claim 1 wherein the distance between each first securing means of each mounting bracket and the second plane are substantially identical.

9. The display cabinet as defined in claim 1 wherein said second securing means are disposed as a pair with respect to each mounting bracket on opposite sides of said first plane.

10. The display cabinet as defined in claim 1 wherein said second securing means are disposed as a pair with respect to each mounting bracket on opposite sides of said first plane, and each second securing means pair are a pair of openings.

11. The display case as defined in claim 3 wherein each mounting bracket is of a substantially T-shaped configuration.

12. The display case as defined in claim 3 wherein each mounting bracket is of a substantially T-shaped configuration defined by a leg and oppositely directed arms, and said leg and arms include said respective first and second securing means.

13. The display cabinet as defined in claim 3 wherein said first and second securing means each include at least one opening.

14. The display cabinet as defined in claim 3 wherein the distance between each first securing means of each mounting bracket and the second plane are substantially identical.

15. The display cabinet as defined in claim 3 wherein said second securing means are disposed as a pair with respect to each mounting bracket on opposite sides of said first plane.

16. The display cabinet as defined in claim 3 wherein said second securing means are disposed as a pair with respect to each mounting bracket on opposite sides of said first plane, and each second securing means pair are a pair of openings.

17. The display cabinet as defined in claim 14 wherein said second securing means are disposed as a pair with respect to each mounting bracket on opposite sides of said first plane.

18. The display cabinet as defined in claim 14 wherein said second securing means are disposed as a pair with respect to each mounting bracket on opposite sides of said first plane, and each second securing means pair are a pair of openings.

19. The display cabinet as defined in claim 17 wherein said first securing means are disposed as a pair with respect to each mounting bracket.

* * * * *